United States Patent [19]

Hammond

[11] 3,967,423

[45] July 6, 1976

[54] SKYLIGHT SYSTEM

[76] Inventor: Robert T. Hammond, N. Main St., Plaistow, N.H. 03865

[22] Filed: July 28, 1975

[21] Appl. No.: 599,695

[52] U.S. Cl. ..... 52/200; 52/573; 52/616

[51] Int. Cl.[2] ..... E04B 7/18

[58] Field of Search ..... 52/573, 202, 200, 204, 52/72, 616, 19, 55, 398, 66, 397, 199, 60; 49/126, 404

[56] References Cited

UNITED STATES PATENTS

| | | | |
|---|---|---|---|
| 1,067,546 | 7/1913 | Pirie et al. | 52/66 X |
| 1,152,655 | 9/1915 | Sheddon | 49/426 |
| 1,233,960 | 7/1917 | Bernard | 52/72 X |
| 1,898,813 | 2/1933 | Carlson | 52/72 |
| 2,291,726 | 8/1942 | Kaufmann | 52/211 X |
| 2,565,200 | 8/1951 | Burress | 52/573 X |
| 2,766,859 | 10/1956 | Urquhart | 52/72 X |
| 3,277,619 | 10/1966 | Miller et al. | 52/72 |
| 3,465,483 | 9/1969 | Miller | 52/72 |
| 3,815,299 | 6/1974 | Lennart et al. | 52/72 X |
| 3,837,119 | 9/1974 | Conneally | 49/404 |

FOREIGN PATENTS OR APPLICATIONS

| | | | |
|---|---|---|---|
| 240,969 | 5/1960 | Australia | 49/404 |
| 86,903 | 2/1959 | Denmark | 52/398 |
| 2,127,272 | 12/1971 | Germany | 52/397 |
| 152,160 | 2/1931 | Switzerland | 52/19 |
| 416,037 | 1/1967 | Switzerland | 52/200 |

*Primary Examiner*—Ernest R. Purser
*Assistant Examiner*—Leslie A. Braun
*Attorney, Agent, or Firm*—Morse, Altman, Oates & Bello

[57] ABSTRACT

A skylight system is provided for installation on a roof in such a manner to remain weather-tight over a wide range of temperatures. Transparent of translucent panels in aluminum frames are mounted to a steel roof of a building by suitable connectors. Upon a change in temperature, the aluminum frame will expand or contract at a rate different from that of the steel roof, causing relative displacement between the skylight and the roof. To allow for a weather-proof seal to be maintained between the skylight and the roof, a slip joint is provided by means of an aluminum flange fixed to the skylight frame and having an inwardly extending lip spaced above and parallel to the outer face of the skylight and a steel flashing having a U-shaped bend along its free edge slipped over the lip of the flange and at its opposite edge being attached to the roof. A slip joint is thus provided between the lip of the aluminum flange and the U-shaped bend of the steel flashing to allow expansion and contraction of the skylight with respect to the roof without impairing the weather-tight seal.

8 Claims, 10 Drawing Figures

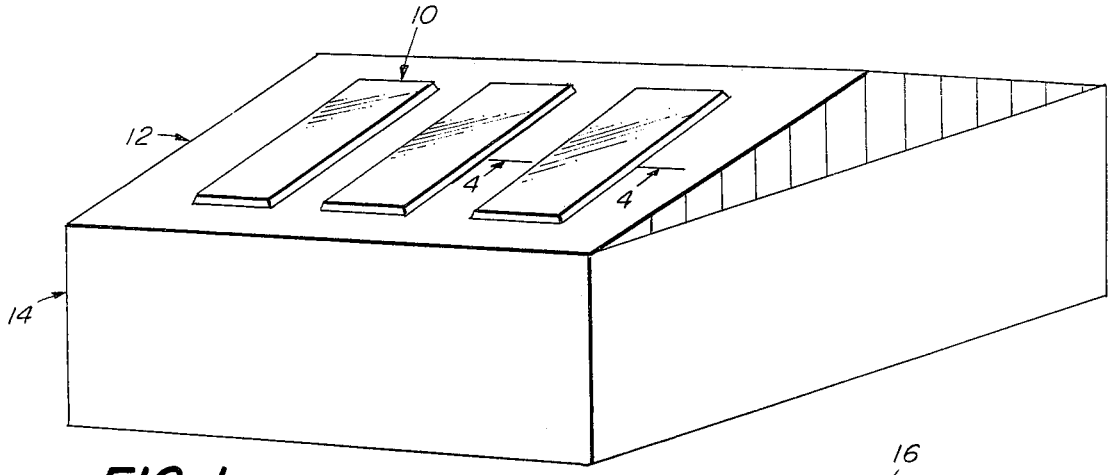
FIG. 1
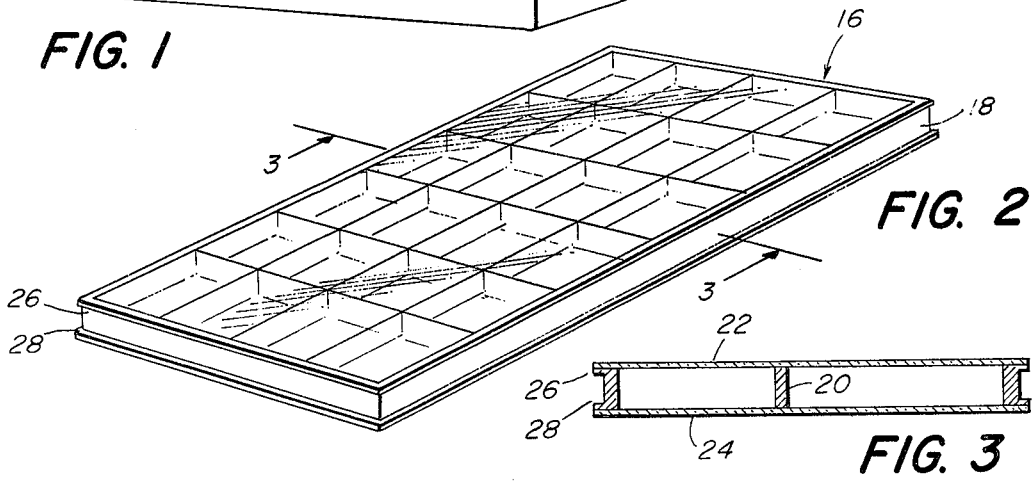
FIG. 2
FIG. 3
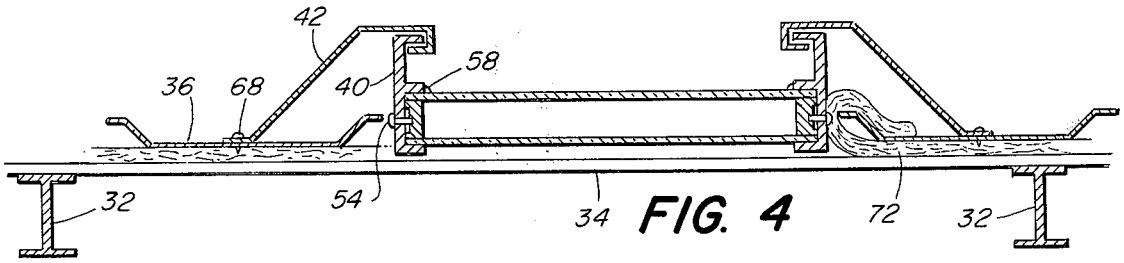
FIG. 4
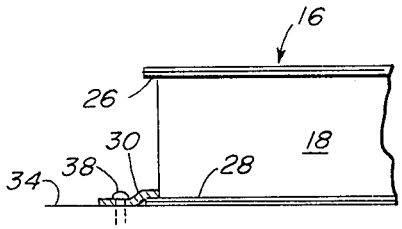
FIG. 5
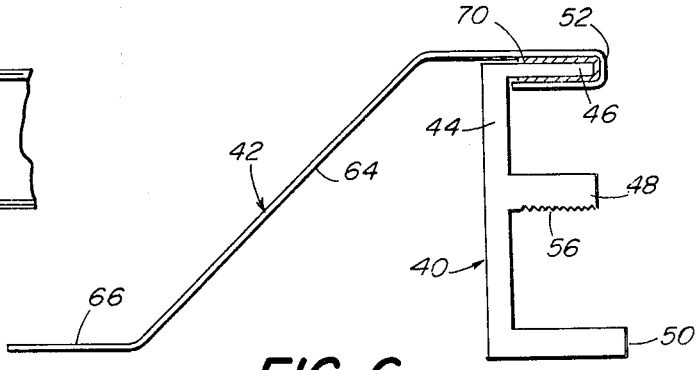
FIG. 6

SKYLIGHT SYSTEM

BACKGROUND OF THE INVENTION

1. Field of the Invention

This invention relates generally to skylight construction and more particularly is directed towards a new and improved sealing arrangement for skylights to maintain a weather-tight joint between a skylight and a roof having different co-efficients of thermal expansion.

2. Description of the Prior Art

Skylights built into the roofs of buildings have been in use for many years and serve to illuminate as well as to ventilate, when open, the interiors of buildings. In general, there is no great difficulty in installing a wooden framed skylight onto a wooden building or even onto a metal building where the skylight is small and conventional roofing sealing techniques may be used to advantage. However, considerable difficulties have been encountered where the skylight is relatively large and is fabricated from a material having a different co-efficient of thermal expansion from that of the roof to which it is installed. For example, skylights having aluminum frames have been installed on the roofs of steel buildings, but the result heretofore have been unsatisfactory. It has been found that installations of this type are extremely difficult to seal properly for any extended period of time. The aluminum frames of such skylights expand and contract under changing ambient temperatures at a rate different from the steel roof to which it is mounted. The condition causes relative movement between the skylight and the roof frequently resulting in the formation of leaks between the roof and the skylight. Various measures have been attempted to correct this problem but the results heretofore have not been effective, especially over the long term.

Accordingly, it is an object of the present invention to provide improved means for installing skylights in a manner to prevent leakage over a wide range of ambient temperatures. Another object of this invention is to provide improved sealing systems for use with a skylight fabricated from a material having a co-efficient of thermal expansion different from that of the roof to which it is mounted.

SUMMARY OF THE INVENTION

This invention features a new system for installing a skylight to a roof of dissimilar materials comprising a flange fixed to the skylight frame and formed with an outer lip extending in spaced parallel relation to the outer face of the skylight, the flange being of a material having the same coefficient of thermal expansion as the skylight frame, and a flashing fixed at one end to the roof and at the other end formed with a U-shaped bend slidably engaging the lip in a slip joint, the flashing having a co-efficient of thermal expansion similar to that of the roof whereby a weather-tight seal will be maintained between the lip and the bend regardless of relative movement between the skylight and the roof.

BRIEF DESCRIPTION OF THE DRAWINGS

FIG. 1 is a view in perspective of a building with a skylight installation system made according to the invention, FIG. 2 is a view in perspective of a skylight panel, FIG. 3 is a cross-sectional view taken along the line 3—3 of FIG. 2, FIG. 4 is a cross-sectional view taken along the line 4—4 of FIG. 1, FIG. 5 is a detailed view of the panel mounting arrangement, FIG. 6 is an enlarged detail view showing a flange and flashing member assembled to one another.

DETAILED DESCRIPTION OF THE PREFERRED EMBODIMENT

Figure 7:
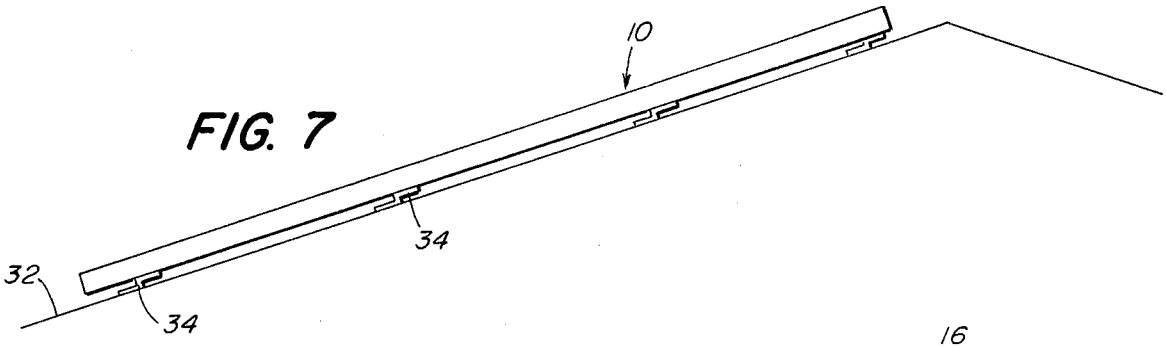
FIG. 7 is a view in side elevation showing a skylight system partially installed on the roof of a building.

Referring now to the drawings, the reference character 10 generally indicates a skylight installed on a roof 12 of a building 14. Typically the building 14 may be used for a variety of purposes such as enclosing tennis courts, swimming pools or any activity where the natural lighting is desirable as a means for illuminating the interior of the building. The skylights are generally rectangular in outline and typically are formed in panels 16 mounted in end-to-end relation to form a continuous skylight section extending from a point near the peak of the roof 12 to a point near the eaves thereof. In a common installation, the upper end of each skylight will terminate approximately 5 feet from the peak while the lower end terminates approximately 15 feet from the eaves. The dimensions of a typical skylight panel 16 as shown in FIG. 2 would be on the order of 5 ft in width by 10 ft. in length. In the preferred embodiment of the invention, the skylight panel 16 is comprised of an extruded aluminum frame 18 of rectangular outline on the order of 2½ inches deep and attached to a center grid work 20 having the same depth as the frame. The panel is closed on both sides by the translucent panes 22 and 24 preferably of a tough, durable plastic material bonded at the margins to the outer edges of the frame. The frame 18 is formed with marginal lips 26 and 28 extending outwardly from the frame and serve to engage mounting clips 30 (FIG. 5) for securing the panel to the roof 12 in the manner to be described below. The skylights of this construction are relatively light in weight yet extremely strong and durable.

The building 14 is of typical steel construction at least in the roof portion 12. The sides of the building may also be of a steel construction covered with a suitable facing material or may be constructed of bricks, concrete block or the like. In any event, the roof 12 typically is fabricated by rafters 32 of steel I beams normally spaced apart by a distance of 24 ft. These rafters extend from the eaves to the peak of the roof being supported and connected in the usual manner. On top of the rafters are horizontally extending purlins 34 (FIG. 7) also of steel and spaced apart on the order of 4–5 ft. The purlins 34 typically are elongated strips of steel formed with offset portions, the lower of which are fastened to the rafters while the upper portions connect to and support the skylight 10 and steel roofing sheets 36 covering that portion of the roof 12 not covered by the skylight. The mounting clips 30, as best shown in FIG. 5, attached directly to the purlins 34 by means of a suitable connecting device such as a rivet 38, self-tapping screw, or the like. The clip 30 is in the form of a short metal piece, having a flat portion which lies against the purlin 34 and punched out to receive the rivet 38. The clip also has an offset portion which engages the lip 28 of the skylight panel 18 to held it in place.

Figure 8:
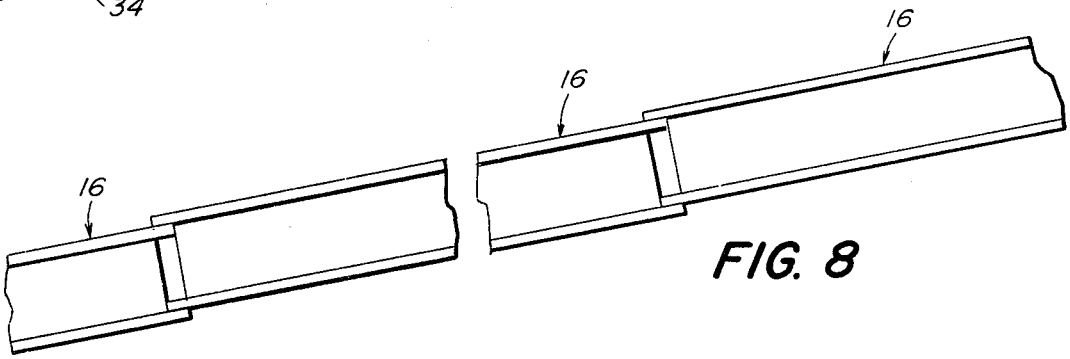
FIG. 8 is a view similar to FIG. 7 on an enlarged scale showing the sealing arrangement of adjacent skylight panels.

While the individual panels 16 may be installed in end-to-end co-planar relation, preferably they are installed in a shingle manner as best shown in FIG. 8 with the lips 26 and 28 of an uppermost adjacent panel 16 overriding the lips 26 and 28 of the lowermost panels as illustrated. In this fashion, a better weather-proof seal is formed between the panels and the liklihood of leakage developing between adjacent panels is reduced.

Figure 10:
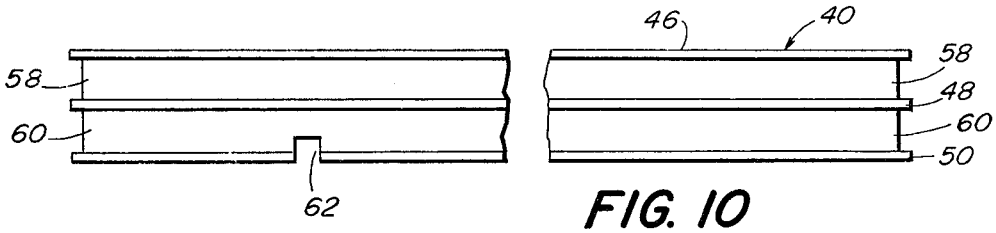
Figure 9:
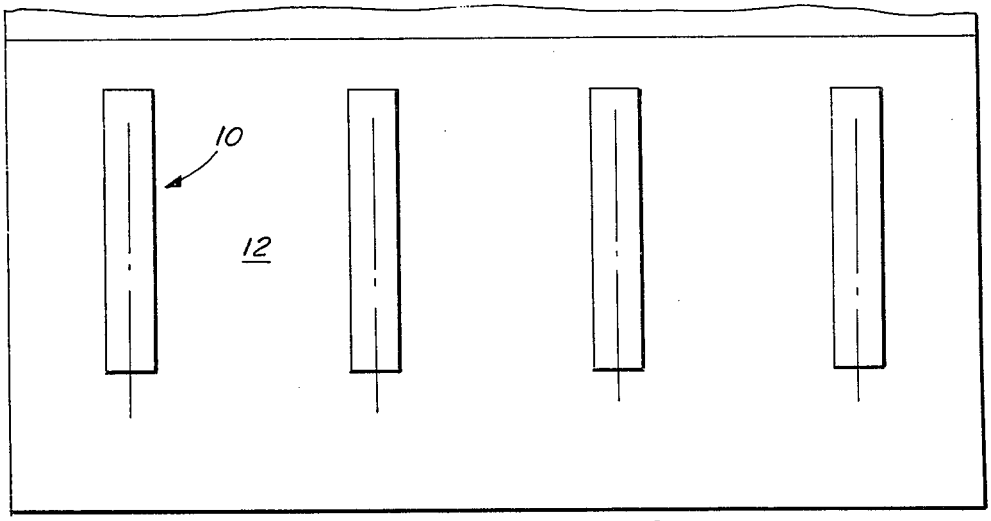
FIG. 9 is a top plan view of a typical multiple skylight installation, and, FIG. 10 is a view in side elevation of a flange made according to the invention.

Insofar as the co-efficient of thermal expansion of the steel roof differs from that of the aluminum framed skylight 10, relative movement will occur after the skylights are installed and the building undergoes a significant change in temperature. The greater the change in ambient temperature, the greater will be the relative displacement between the roof and the skylight and the longer the length of the skylight, the greater effect of relative movement wll be displayed. Normally, this type of relative movement presents serious leakage problems which heretofore could not be overcome by conventional means. In accordance with the present invention, the leakage problem is resolved by means of a flange 40 fastened to the skylight panel 16 along both long sides thereof, each flange cooperatively engaging a flashing 42 secured to the roof 12. In practice, the flange 40 is fabricated from aluminum and preferably is extruded aluminum part, E-shaped in cross-section as best shown in FIG. 6. The flange includes a main body portion 44 with three perpendicular legs 46, 48 and 50 of substantially the same length, typically about 1 inch. The upper leg 46 is a lip to slidably engage a U-shaped bend 52 formed along the outer free edge of the flashing 42. The legs 48 and 50 are spaced apart from one another by a distance corresponding to the thickness of the skylight panel 18 so that the parts may be pressed snugly together and secured as by means of a rivet 54, screw or the like. The lip 46 may be spaced from the leg 48 by a distance of perhaps 1½. To further enhance the sealing action between the flange 40 and the skylight panel, the lower face of the leg 48 may be formed with a series of shallow ribs and grooves 56 and, once in place, a bead 57 of a suitable sealing compound such as silicone rubber or the like may be applied on the upper, outer face of the pane 22 and the outer end of the leg 48, as best shown in FIG. 4. In order to accommodate the shingling fit of adjacent skylight panels in the manner suggested in FIG. 8, the ends of the flange 40 are cut away at 58 and 60 on the order of one-fourth to one-half inch. In order to accommodate the mounting clips 30 each flange 40 is formed with notches 62 of perhaps 1 ½inches in width at intervals corresponding to the spacing between adjacent Purlins. Each notch 62 is formed in the lower edge of the body 44 of the flange as well as through the lower leg 50 thereof as best shown in FIG. 10. While the flange 40 is shown as a part separate from the skylight frame 18, the two could be made as a single piece.

The lip 46 extends in spaced parallel relation inwardly from the outer face of the skylight panel and engages the U-shaped bend 62 of the flashing 42. The flashing 42 is formed with a diagonal medial portion 64 joining the U-shaped bend 52 at its outer end and a flat margin 66 at its lower end which lies flat against the roof sheeting 36 to which it is secured as by a rivet 68 or other suitable fastening means driven through both the flashing and the metal sheet 36. In practice, a strip sealant may be applied between the margin 66 and the roof sheet 36. The flashing 42 preferably is fabricated from sheet steel of constant thickness bent into the configuration shown in FIG. 6. Insofar as the flashing 42 is of the same metal as the roof 12, it will expand and contract with the roof 12 at the same rate. Similarly, since the flange 40 is fabricated of aluminum and is thus of the same metal as the skylight frame 18, it will expand and contract with the skylight at the same rate. The relative movement between the roof and the skylight takes place without affecting the weather-tight seal by virtue of the slip joint formed by the U-shaped bend 52 of the flashing and the lip 46 of the flange 44. These two parts move with respect to one another without leaking so that the skylight system will remain weather-tight regardless of wide changes in temperature as normally occur during the course of the year.

In order to reduce the possibility of the flange 44 binding to the flashing 42 a lubricant may be added at the slip joint between the U-shaped bend and the lip 46. Alternatively, a strip of pressure-sensitive plastic 70 may be applied along the lip 46 before adding the flashing 42. In order to inhibit the formation of condensation within the area between the flashing and the roof, a layer of fiberglass insulation 72 or the like may be applied under the roof and folded up over the edge of the roof sheet 36 to close off the gap between the edge of the sheet 36 and the skylight panel as best shown in FIG. 4.

As a modification of the invention the flange may be formed with a vertically straight lip and the flashing formed with an inverted U-shaped bend positioned over the top of the lip.

Having thus described the invention, what I claim and desire to obtain by Letters Patent of the United States is:

1. A system for maintaining a weather-tight seal between an elongated skylight having a frame of one material and a roof of another material having dissimilar expansion characteristics comprising:

a. a flange mountable along the side edges of said skylight and of a material having an expansion characteristic similar to that of said frame;

b. said flange being formed with an outer lip extending in spaced relation to the outer surface of said skylight; and c. an elongated flashing mountable along one edge to said roof and of a material having an expansion characteristic similar to that of said roof;

d. said flashing being formed along the opposite edge with a U-shaped channel slidably engaging said flange lip to form a slip joint therewith.

2. A system according to claim 1 wherein said lip extends inwardly of said panel in spaced parallel relation to the outer face of said skylight.

3. A system according to claim 1 wherein said one material is aluminum and said other material is steel.

4. A system according to claim 1 including lubricating means between said lip and said channel.

5. A system according to claim 4 wherein said lubricating means is plastic tape.

6. A system according to claim 1 wherein said flange is E-shaped in cross-section.

7. A system according to claim 6 wherein said flange includes a body portion and three parallel legs extending perpendicularly from one face of said body portion, the outermost leg defining said lip and the other legs engaging said skylight.

8. A system according to claim 7 wherein at least one of the other of said legs is formed with longitudinal ribs along the skylight engaging face thereof.

* * * * *